US012721457B2

(12) United States Patent
Gong

(10) Patent No.: US 12,721,457 B2
(45) Date of Patent: Sep. 1, 2026

(54) DECORATIVE PAINTING ASSEMBLY CONVENIENT FOR TRANSPORTATION

(71) Applicant: Zhejiang Wadou Creative Art Co., Ltd., Yiwu (CN)

(72) Inventor: Xinming Gong, Yiwu City (CN)

( * ) Notice: Subject to any disclaimer, the term of this patent is extended or adjusted under 35 U.S.C. 154(b) by 42 days.

(21) Appl. No.: 19/010,201

(22) Filed: Jan. 6, 2025

(65) Prior Publication Data

US 2026/0191345 A1 Jul. 9, 2026

(51) Int. Cl.
*A47G 1/06* (2006.01)

(52) U.S. Cl.
CPC ..... *A47G 1/065* (2013.01); *A47G 1/0616* (2013.01); *A47G 2001/0661* (2013.01)

(58) Field of Classification Search
CPC ..... A47G 1/065; A47G 1/0616; A47G 2001/0661
See application file for complete search history.

(56) References Cited

U.S. PATENT DOCUMENTS 6,305,112 B1 * 10/2001 Hansen ..... A47G 1/0605 40/792
7,411,659 B1 * 8/2008 Gaetano ..... G03B 27/58 355/126
2005/0193614 A1 * 9/2005 Conrad ..... A47G 1/065 40/757
2007/0289187 A1 * 12/2007 Vincent ..... A47G 1/065 40/729
2017/0224136 A1 * 8/2017 Guitton ..... A47G 1/065
2019/0269262 A1 * 9/2019 Kacius ..... A47G 1/1613

* cited by examiner

*Primary Examiner* — Gary C Hoge
(74) *Attorney, Agent, or Firm* — Sandy Lipkin

(57) ABSTRACT

The present application discloses a decorative painting assembly convenient for transportation, comprising a plurality of decorative picture frames with sizes progressively decreasing in proportion. The decorative picture frames are fixed with primary canvases, and the decorative picture frames are nested and stacked in sequence based on their sizes in proportion. The application achieves stacking of all decorative paintings according to their sizes in sequence, allowing for packaging of all decorative paintings with just one packaging box, which occupies little space and reduces logistics costs. Additionally, by arranging the tightening structure and compressing structure, the overall structure of the decorative painting assembly is made very stable.

10 Claims, 17 Drawing Sheets

DECORATIVE PAINTING ASSEMBLY CONVENIENT FOR TRANSPORTATION

TECHNICAL FIELD

This application relates to the technical field of a decorative painting, particularly to a decorative painting assembly convenient for transportation.

BACKGROUND ART

Decorative paintings are artworks that integrate decorative function and aesthetic appreciation. With advancements and developments in science and technology, the carriers and expressions of decorative paintings have become increasingly diverse, significantly enhancing people's pursuit and love for quality life today. By selecting different types of decorative paintings and arranging and matching them reasonably, a unique home atmosphere can be created, showcasing the taste and personality of the residents.

To facilitate placement or hanging, decorative paintings are mostly provided with decorative frames, on which the canvas is fixed. To protect the integrity of the canvas and prevent damage during transportation, many decorative paintings opt to package the canvas and decorative frame together. If the decorative frame is large, even wooden framing is added outside the decorative frame to enhance transportation safety. Decorative paintings generally come in various sizes, and currently, different-sized packaging boxes are provided for different-sized decorative paintings for individual packaging. This results in high packaging costs as well as high logistics costs. Moreover, since the canvas on decorative paintings cannot be folded or rolled, the volume of logistics packaging cannot be reduced through deformation of the decorative frame.

SUMMARY

To address the aforementioned issues, the present application proposes a decorative painting assembly that is convenient for transportation.

The technical solution adopted by the present application is as follows. A decorative painting assembly convenient for transportation comprises a plurality of decorative frames with progressively decreasing sizes. Canvases are fixed to these decorative frames, with each canvas at least comprising a main canvas laid flat on the front side of the corresponding decorative frame. All decorative frames are nested and stacked in sequence based on their size in proportion, with the main canvases of all decorative frames oriented towards the same side. The outermost decorative frame is configured as the outer frame. Between adjacent decorative frames, the front surface of the main canvas on one decorative frame abuts against the rear surface of the main canvas on the other decorative frame. Additionally, a tightening structure is provided between the outer side of one decorative frame and the inner side of the other to restrict relative movement in the horizontal direction between adjacent decorative frames. The decorative painting assembly also comprises a cover plate installed on the rear side of the outer frame, with the cover plate provided with a compressing structure for compressing all decorative frames located inside the outer frame.

Several optional features are provided below, which do not constitute additional limitations to the aforementioned overall solution but are merely further supplements or preferences. In the absence of technical or logical contradictions, each optional feature can be individually combined with the overall solution or combined with other optional features.

Preferably, each decorative frame and its corresponding main canvas collectively form a decorative painting, with a thin film laid flat on the front surface of the main canvas and positioned between the main canvases of adjacent decorative paintings.

Preferably, the tightening structure comprises at least one first magnet provided on the inner side of the decorative frame and at least one second magnet provided on the outer side of the decorative frame. Adjacent decorative frames are securely connected in the horizontal direction through the magnetic attraction between the first and second magnets.

Preferably, the compressing structure comprises several spaced-apart springs fixed to the front side of the cover plate, with the front end of each spring provided with a soft abutment block that abuts against the rear end of the corresponding decorative frame.

Preferably, the decorative frame comprises several frame profiles interconnected end-to-end, with connecting corner brackets provided between the ends of adjacent frame profiles.

Preferably, the rear end of the frame profile is provided with a second slot extending along its length, and the front side of the cover plate is provided with a locating strip for insertion into the second slot of the outer frame.

Preferably, the inner side of the second slot is provided with a horizontally arranged locking groove, the extension path of the locating strip is provided with at least one rotational clearance, the cover plate is provided with a through-hole for placing a rotating rod, the rear end of the rotating rod is provided with a slot hole for inserting a screwdriver, the front end of the rotating rod is provided with a limiting block, the limiting block has an internal state where it is concealed within the rotational clearance, and a limiting state where it rotates and extends one end into the latch groove.

Preferably, the rear end of the frame profile is provided with a first insertion slot extending along its length, with at least one fixing strip installed on the first insertion slot. The canvas also comprises a side wrapping cloth and a rear wrapping cloth disposed along the edges of the main canvas. The side wrapping cloth tightly abuts against the outer side of the frame profile, and the rear wrapping cloth is disposed on the rear side of the frame profile. The fixing strip is configured to press part of the rear wrapping cloth into and fix it within the first insertion slot.

Preferably, the inner side of the first insertion slot is provided with at least one first clamping strip, and the fixing strip comprises an integrally formed insertion portion and abutment portion. The insertion portion extends into the first insertion slot and, together with the first clamping strip, fixes the rear wrapping cloth located inside the first insertion slot. The abutment portion is configured to press and fix the rear wrapping cloth located outside the first insertion slot onto the rear side of the frame profile.

More preferably, the inner side wall of the frame profile is provided with a recess extending along its length, which is configured to accommodate the insertion of fingers.

Compared with the prior art, the present application has the following beneficial effects.

1. The decorative painting assembly comprises a plurality of decorative paintings with progressively decreasing sizes. By stacking all decorative paintings in sequence based on their sizes and orienting all canvases towards the same side, all smaller decorative paintings can be provided inside larger ones. As a result, the space occupied by the entire decorative painting assembly is basically the same as that occupied by the largest decorative painting. Therefore, only one packaging box is needed to package all decorative paintings, resulting in small occupied space and low logistics costs.

2. Since the inner side of the decorative frame is provided with first magnets and the outer side is provided with second magnets, adjacent decorative paintings can be securely connected in the horizontal direction through the magnetic attraction between the first and second magnets. Additionally, by installing a plurality of springs and abutment blocks on the cover plate, all decorative paintings can be compressed and fixed onto adjacent ones, making the overall structure of the decorative painting assembly very stable. Even during long-term logistics transportation, there will be no loosening inside the decorative painting assembly, ensuring that none of the decorative paintings are damaged.

3. Since a thin film is provided between the main canvases of adjacent decorative paintings, during transportation, it not only protects the images on the main canvases from damage but also prevents color rubbing between the main canvases of adjacent decorative paintings.

BRIEF DESCRIPTION OF THE DRAWINGS

In order to more clearly illustrate the technical solutions in the embodiments of the present application or the prior art, the following provides a brief introduction to the drawings required for describing the embodiments or the prior art. It is evident that the drawings described below merely represent some embodiments of the present application. For ordinary technicians in the field, other drawings can be obtained based on the structures shown in these drawings without exerting creative efforts.

REFERENCE NUMERALS

Figure 1:
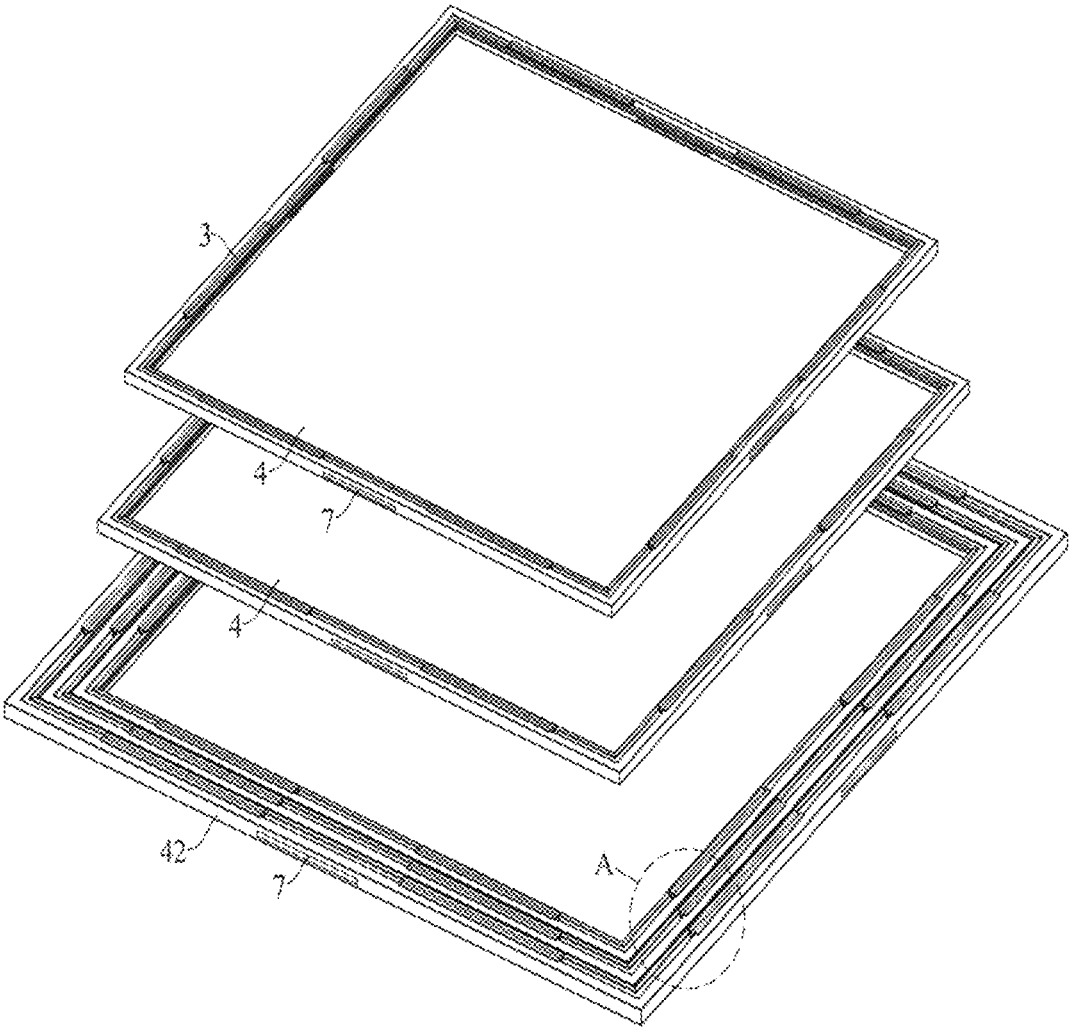
FIG. 1 is an overall structural diagram of an embodiment of the present application, showing the hidden cover plate with two decorative paintings exploded and separated towards the rear side.
Figure 2:
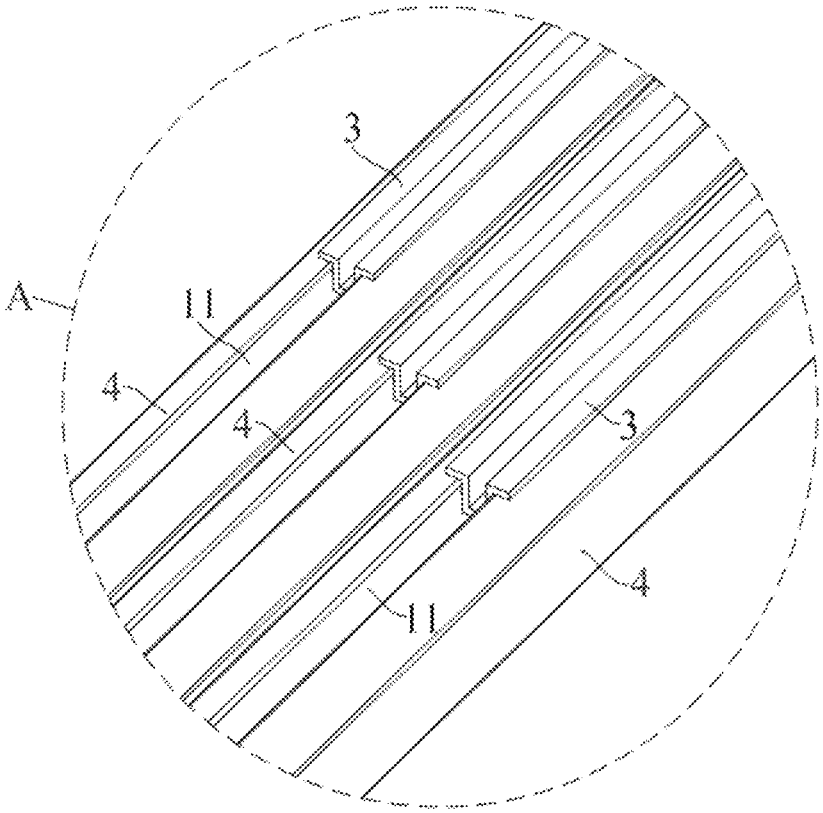
FIG. 2 is a partial enlarged view of Part A in FIG. 1.
Figure 3:
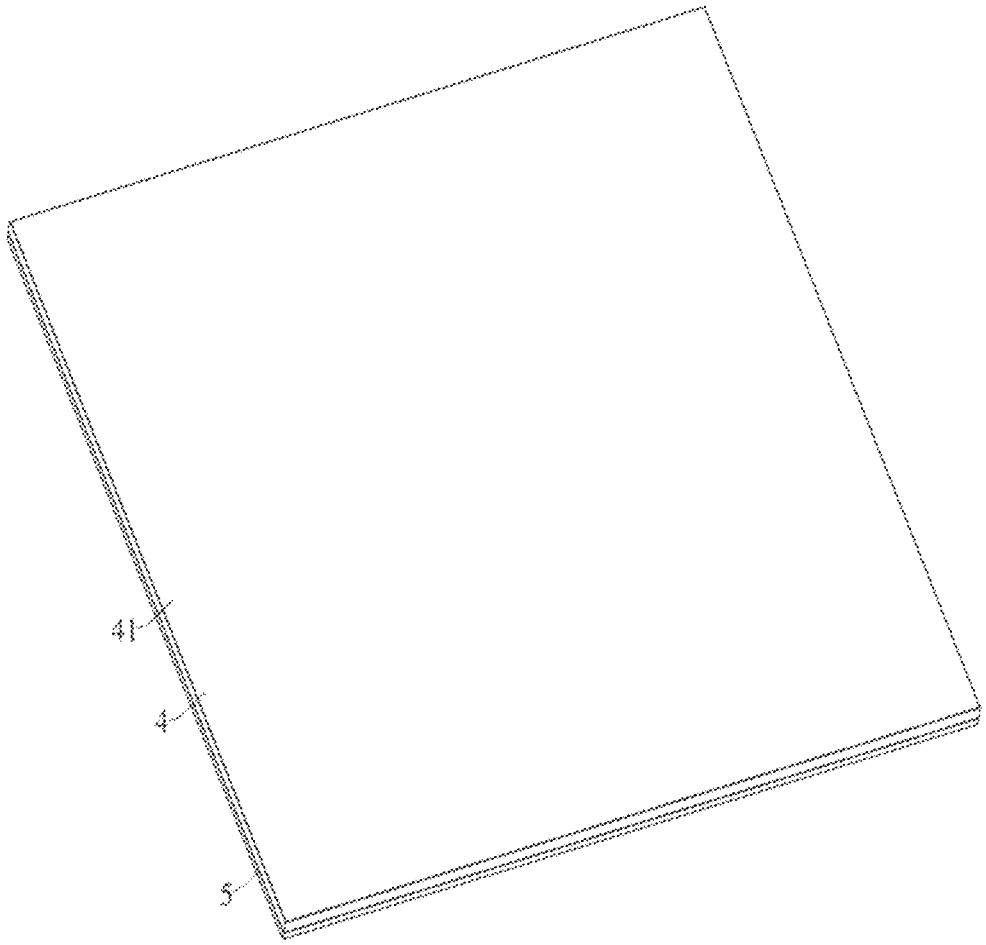
FIG. 3 is an overall structural diagram from the front perspective of an embodiment of the present application.
Figure 4:
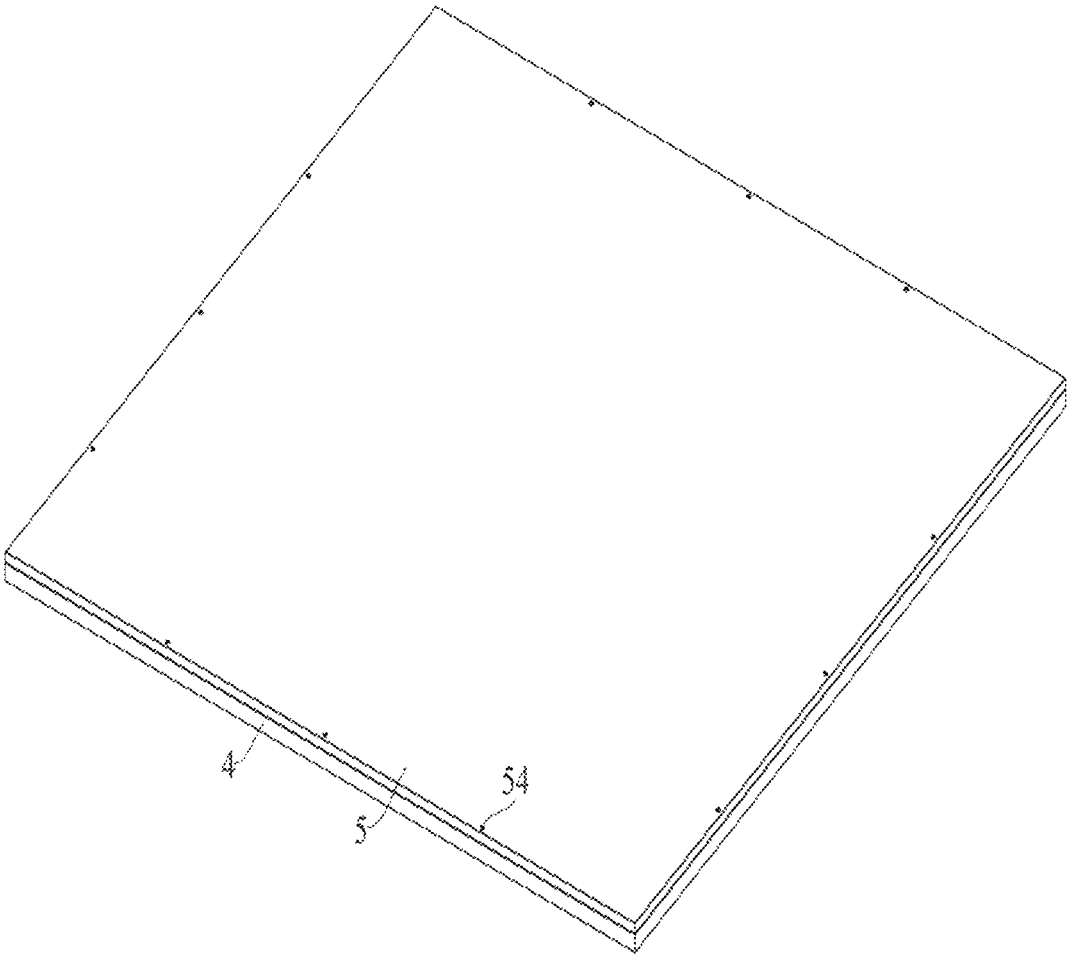
FIG. 4 is an overall structural diagram from the rear perspective of an embodiment of the present application.

1—frame profile, 11—first insertion slot, 12—second insertion slot, 13—recess, 14—first clamping strip, 15—second latch strip, 16—latch groove, 17—built—in slot, 2—connecting corner bracket, 21—support angle part, 22—fixing screw, 3—fixing strip, 31—insertion portion, 32—abutment portion, 33—first anti—slip ridge, 4—canvas, 41—main canvas, 42—side wrapping cloth, 43—rear wrapping cloth, 5—cover plate, 51—positioning strip, 52—second anti-slip ridge, 53—rotation clearance, 54—rotating rod, 55—limiting block, 56—spring, 57—abutment block, 6—first magnetic sheet, 7—second magnetic sheet.

The realization of the purpose, functional features, and advantages of the present application will be further described with reference to the embodiments and drawings.

DETAILED DESCRIPTION

The following provides a clear and complete description of the technical solution in the embodiments of the present application in conjunction with the drawings in the embodiments of the present application. It is apparent that the described embodiments are merely a part of the embodiments of the present application, rather than all of them. Based on the embodiments in the present application, all other embodiments obtained by ordinary technicians in the field without exerting creative efforts fall within the scope of protection of the present application.

It should be understandable that all directional indications (such as up, down, left, right, front, rear, . . . ) in the embodiments of the present application are only configured to explain the relative positional relationships and movement conditions between the components under a specific posture (as shown in the drawings). If the specific posture changes, the directional indications also change accordingly.

In addition, the descriptions involving "first", "second", etc., in the present application are only for descriptive purposes and cannot be understood as indicating or implying their relative importance or implicitly specifying the number of indicated technical features. Thus, features qualified by "first", "second", etc., may explicitly or implicitly comprise at least one of the features. Furthermore, the technical solutions between various embodiments can be combined with each other, but this must be based on the premise that ordinary technicians in the field can achieve it. When the combination of technical solutions results in contradictions or cannot be achieved, it should be considered that such a combination of technical solutions does not exist and is not within the scope of protection required by the present application.

Specific embodiments are shown as follow.

Referring to FIGS. 1-17, the present application relates to a decorative painting assembly convenient for transportation, comprising several decorative picture frames that progressively decrease in size in proportion. Canvases 4 are fixed on the decorative picture frames, and the canvases 4 comprise at least a main canvas 41 laid flat on the front side of the decorative picture frames. All decorative picture frames are layered and nested in sequence based on their size in proportion, and the main canvases 41 of all decorative picture frames are oriented towards the same side. The outermost decorative picture frame is configured as the outer picture frame. Between adjacent decorative picture frames, the front surface of the main canvas 41 of one decorative picture frame abuts against the rear surface of the main canvas 41 of another decorative picture frame. Furthermore, a tightening structure is provided between the outer side of one decorative picture frame and the inner side of another decorative picture frame to restrict relative movement of adjacent decorative picture frames in the horizontal direction. The decorative painting assembly also comprises a cover plate 5 installed on the rear side of the outer picture frame, and the cover plate 5 is provided with a compressing structure for compressing all decorative picture frames located inside the outer picture frame.

As a preferred embodiment of this embodiment, the decorative picture frame and the main canvas 41 together constitute a decorative painting, and a thin film is laid flat on the front surface of the main canvas 41. The thin film is disposed between the main canvases 41 of adjacent decorative paintings.

The thin film can be made of polypropylene (PP) material, which has good waterproof, oil-proof, and chemical corrosion resistance properties. By disposing the thin film on the front surface of the main canvas 41, the thin film can contact the rear side of another main canvas 41, thereby preventing color rubbing between the main canvases 41 of adjacent decorative paintings. This also helps ensure the integrity of the images on all main canvases 41 during transportation.

Figure 12:
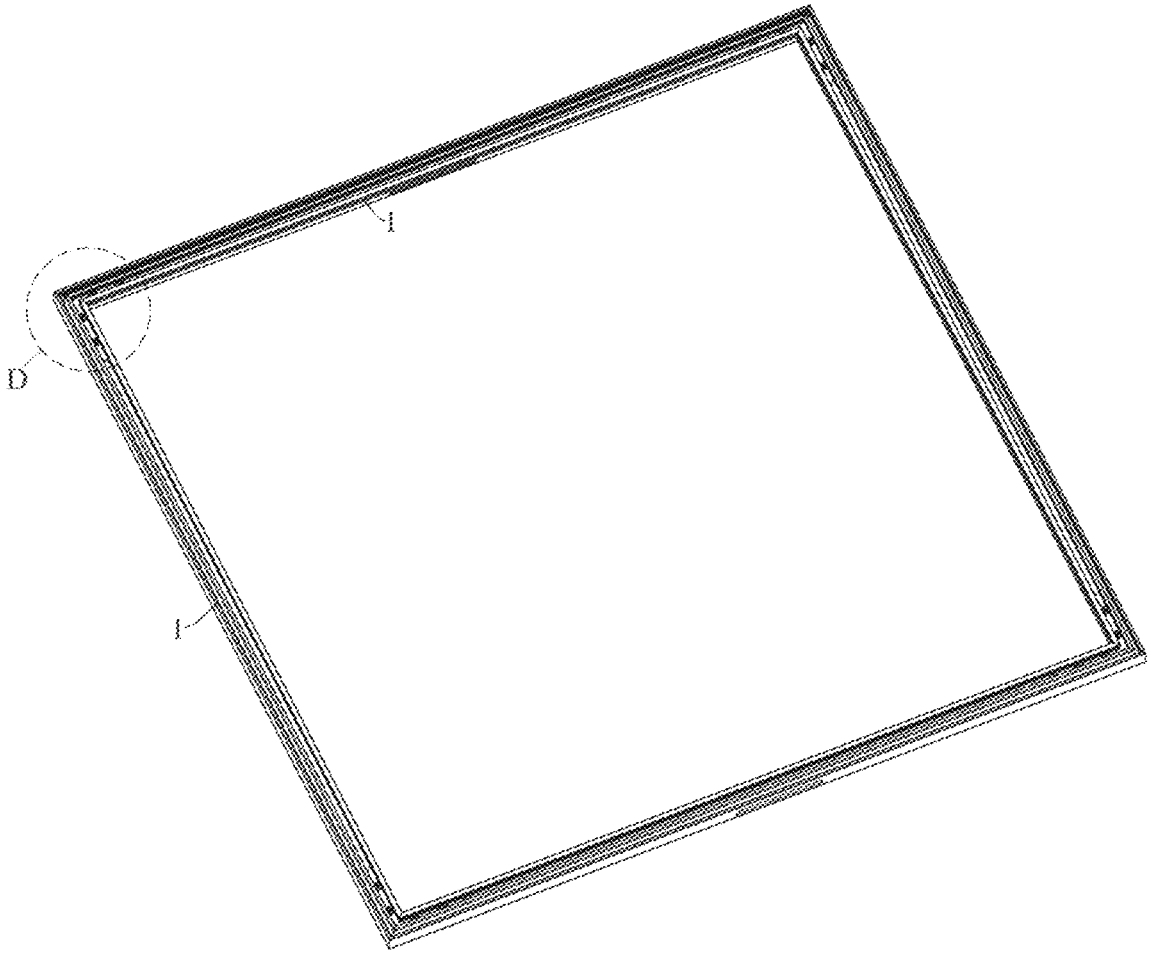
FIG. 12 is a structural diagram of a decorative picture frame in an embodiment of the present application.
Figure 13:
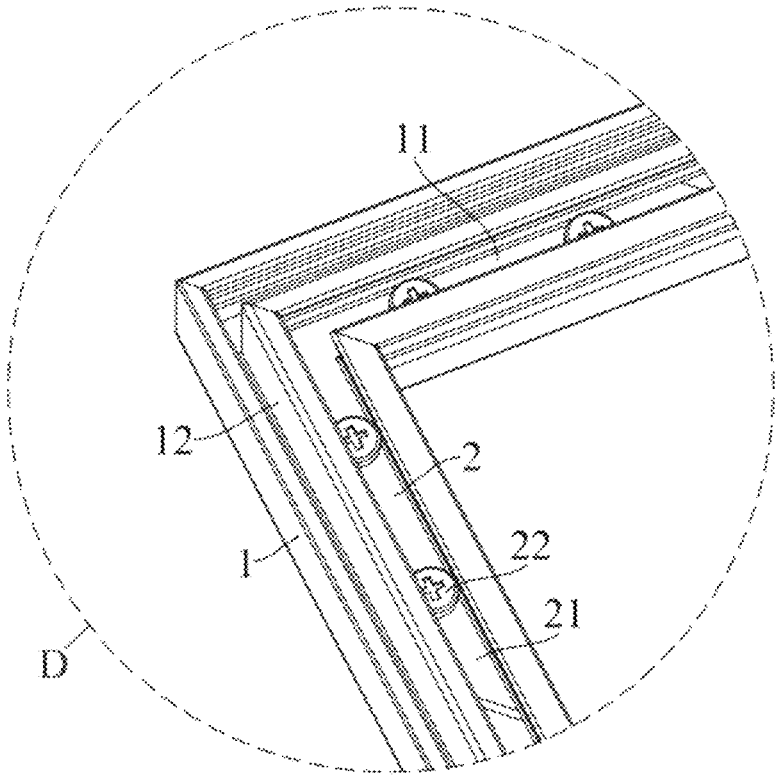
FIG. 13 is a partial enlarged view of Part D in FIG. 12.
Figure 14:
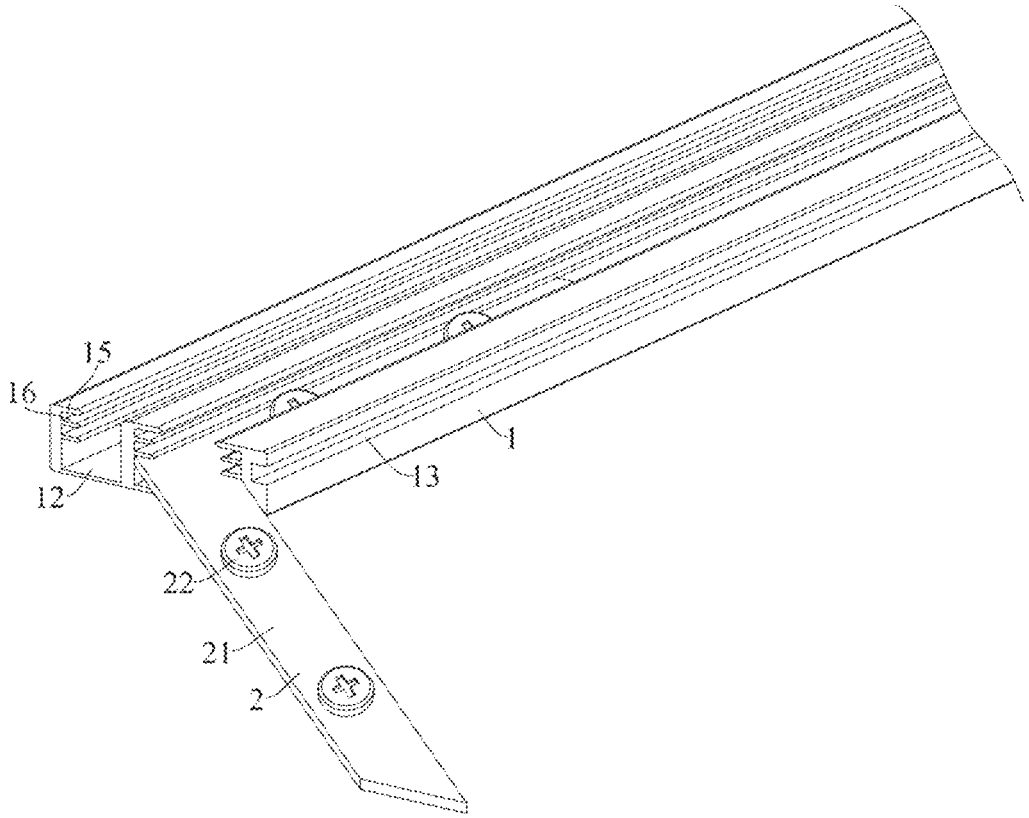
FIG. 14 is a structural diagram of installing a connecting corner bracket at the end of a frame profile in an embodiment of the present application.

Referring to FIGS. 12-14, it can be seen that in this embodiment, the decorative picture frame comprises several frame profiles 1 interconnected end-to-end, and connecting corner brackets 2 are provided between the ends of adjacent frame profiles 1.

Figure 5:
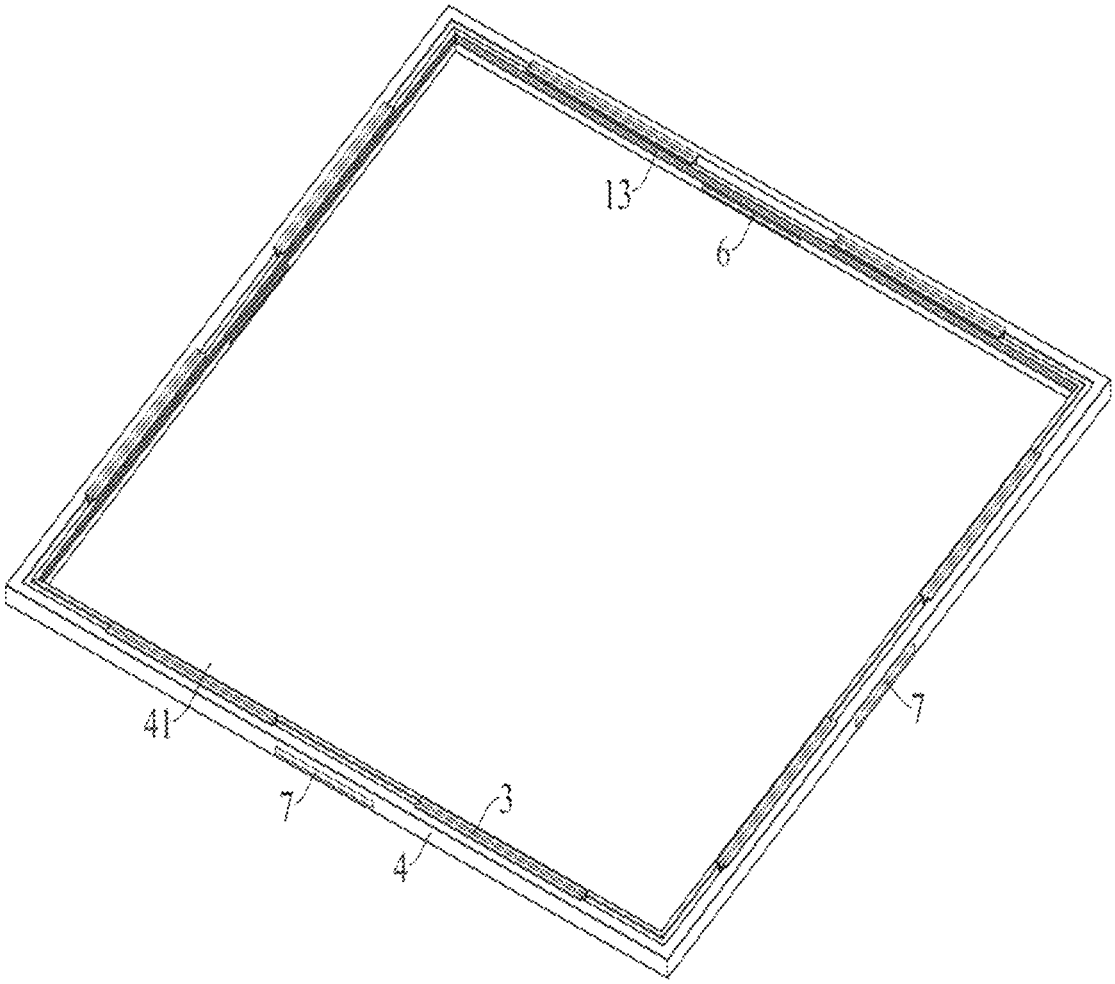
FIG. 5 is a structural diagram of a decorative painting from the rear perspective in an embodiment of the present application.
Figure 6:
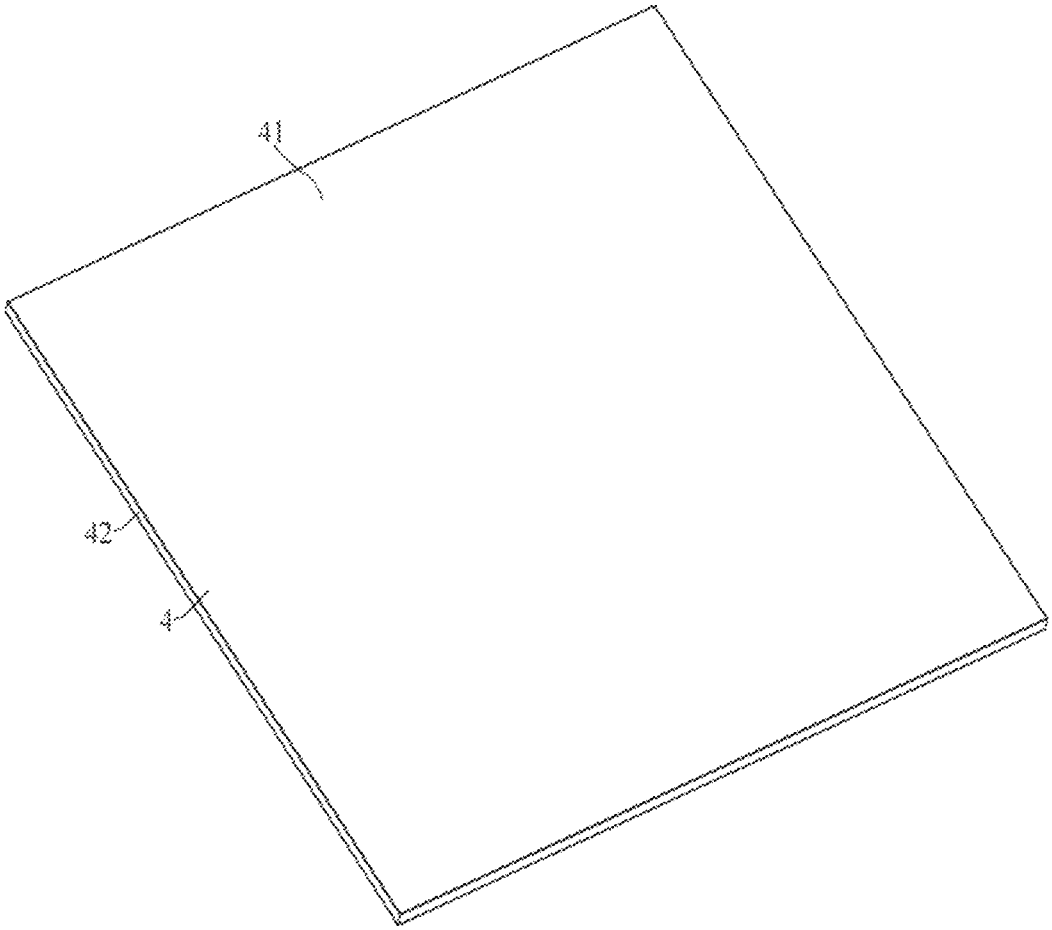
FIG. 6 is a structural diagram of a decorative painting from the front perspective in an embodiment of the present application.
Figure 16:
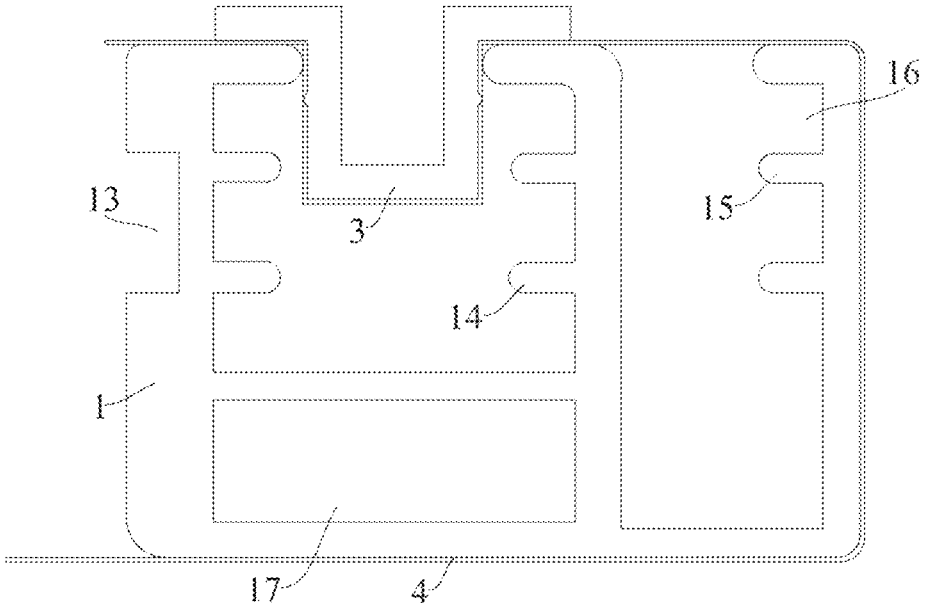
FIG. 16 is a cross-sectional diagram of pressing and fixing the rear wrapping cloth on the frame profile through the fixing strip in the inner decorative frame in an embodiment of the present application.
Figure 17:
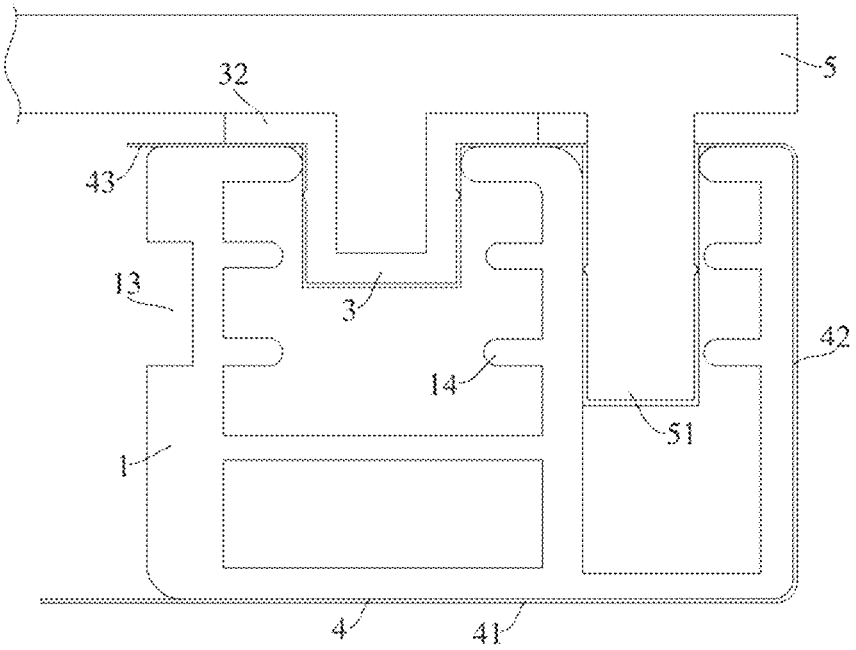
FIG. 17 is a cross-sectional diagram of the frame profile in an external picture frame in an embodiment of the present application.

Furthermore, referring to FIGS. 5, 6, and 16, it can be seen that in this embodiment, the rear end of the frame profile 1 is provided with a first insertion slot 11 extending along its length, and at least one fixing strip 3 is installed on the first insertion slot 11. The canvas 4 also comprises a side wrapping cloth 42 and a rear wrapping cloth 43 disposed along the edge of the main canvas 41. Among them, the side wrapping cloth 42 closely abuts against the outer side of the frame profile 1, and the rear wrapping cloth 43 is arranged on the rear side of the frame profile 1. The fixing strip 3 is configured to press part of the rear wrapping cloth 43 into and fix it within the first insertion slot 11.

In this embodiment, to make the rear wrapping cloth 43 more stably fixed inside the first insertion slot 11, opposite sides within the first insertion slot 11 are provided with a plurality of first clamping strips 14, spaced apart from each other in the longitudinal direction.

In this embodiment, the fixing strip 3 comprises an insertion portion 31 and an abutment portion 32 that are integrally formed. Among them, the insertion portion 31 extends into the first insertion slot 11 and, together with the first clamping strips 14, fixes the rear wrapping cloth 43 located inside the first insertion slot 11. The abutment portion 32 is configured to press the rear wrapping cloth 43 located outside the first insertion slot 11 against the rear surface of the frame profile 1.

Figure 15:
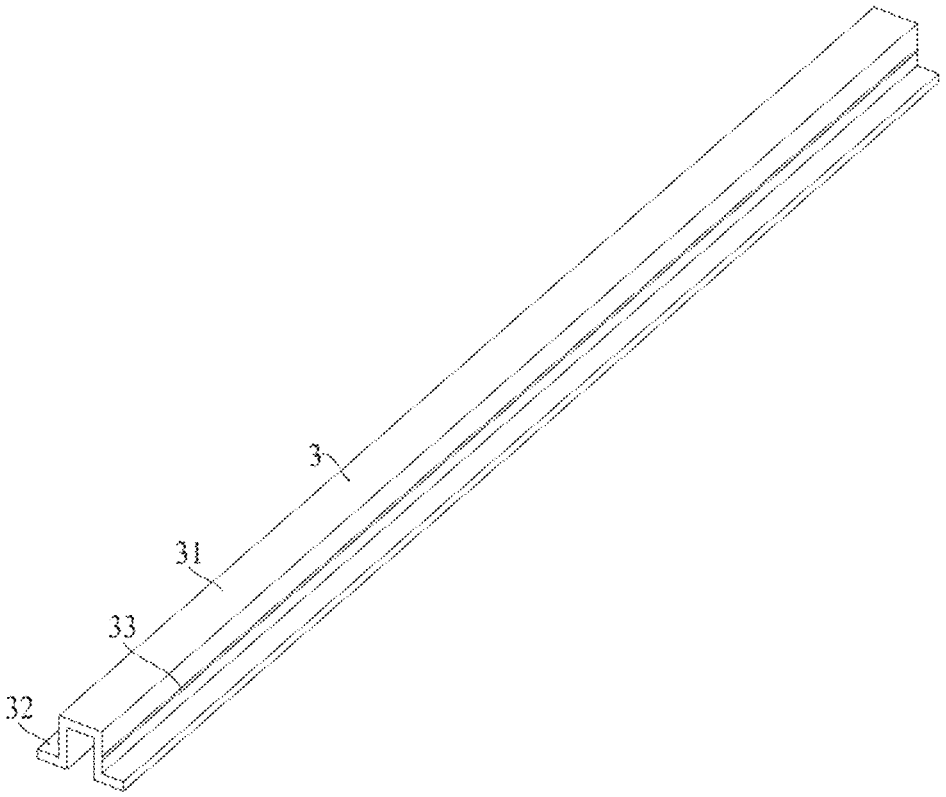
FIG. 15 is a structural diagram of a fixing strip in an embodiment of the present application.

Moreover, referring to FIG. 15, it can be seen that in this embodiment, opposite sides of the insertion portion 31 are respectively provided with at least one first anti-slip ridge 33. By providing the first anti-slip ridge 33, the fixing strip 3 can better press and fix the rear wrapping cloth 43 within the first insertion slot 11. It should be understandable that when the insertion portion 31 is inserted and fixed within the first insertion slot 11, the abutment portion 32 abuts against the rear wrapping cloth 43 located outside the first insertion slot 11 and further fixes the position of the rear wrapping cloth 43.

Assembly process of the decorative picture frame and the canvas 4 is shown as below.

A boundary line is provided between the main canvas 41 and the side wrapping cloth 42. The related steps are described as follow to show that the canvas 4 is how to be fixed to the decorative picture frame. Firstly, the boundary line is aligned with the edge of the frame profile 1; secondly, the side wrapping cloth 42 is folded backward and made abut against the outer side surface of the frame profile 1; thirdly, the rear wrapping cloth 43 is folded inward and arranged on the rear side surface of the frame profile 1; lastly, part of the rear wrapping cloth 43 is pressed into the first insertion slot 11 by hand and the insertion portion 31 of the fixing strip 3 is inserted securely into the first insertion slot 11 until the abutment portion 32 presses and fixes the rear wrapping cloth 43 located outside the first insertion slot 11 against the rear surface of the frame profile 1 to complete the fixation of the rear wrapping cloth 43.

In this embodiment, the decorative picture frame is a square frame, so one decorative picture frame has four frame profiles 1. The connecting corner bracket 2 configured has two support angle parts 21 that form a right angle with each other. The support angle parts 21 are inserted into the gap formed between adjacent first clamping strips 14 and fixed in the frame profile 1 using fixing screws 22.

It should be understandable that the method of interconnecting all frame profiles 1 end-to-end by using connecting corner brackets 2 to form a decorative picture frame belongs to the prior art and is not elaborated further here.

Furthermore, in this embodiment, at least one built-in slot 17 is provided in the frame profile 1 extending along its length to reduce the material cost of the frame profile 1.

Turning to FIGS. 1 and 5, it can be seen that in this embodiment, the tightening structure comprises at least one first magnet 6 disposed on the inner side of the decorative picture frame and at least one second magnet 7 disposed on the outer side of the decorative picture frame. Adjacent decorative picture frames are securely connected to each other magnetically in the horizontal direction through the first magnet 6 and the second magnet 7.

In this embodiment, a first magnet 6 is provided in the middle of the inner side of all frame profiles 1, and a second magnet 7 is provided in the middle of the outer side of all frame profiles 1. The first magnet 6 and the second magnet 7 are both elongated and embedded in the frame profile 1. In this way, even if adjacent decorative picture frames are of different sizes, it can be ensured that the positioning of the second magnet 7 on the smaller decorative picture frame aligns with the first magnet 6 on the larger decorative picture frame and can mutually attract.

Since all frame profiles 1 of the decorative picture frame are provided with first magnets 6 and second magnets 7, it can be ensured that when placing another decorative picture frame inside one decorative picture frame, adjacent decorative picture frames are tightly fixed in the horizontal direction (up, down, left, right), thereby preventing the decorative painting from detaching and shaking in the longitudinal direction.

During the actual installation process, if there are gaps in the horizontal direction between adjacent decorative picture frames, buffer pads (such as EPE foam) can also be inserted into the gaps, thereby enabling the adjacent decorative picture frames to be securely connected. In this case, the first magnetic sheet 6 and the second magnetic sheet 7 may not be required.

Figure 7:
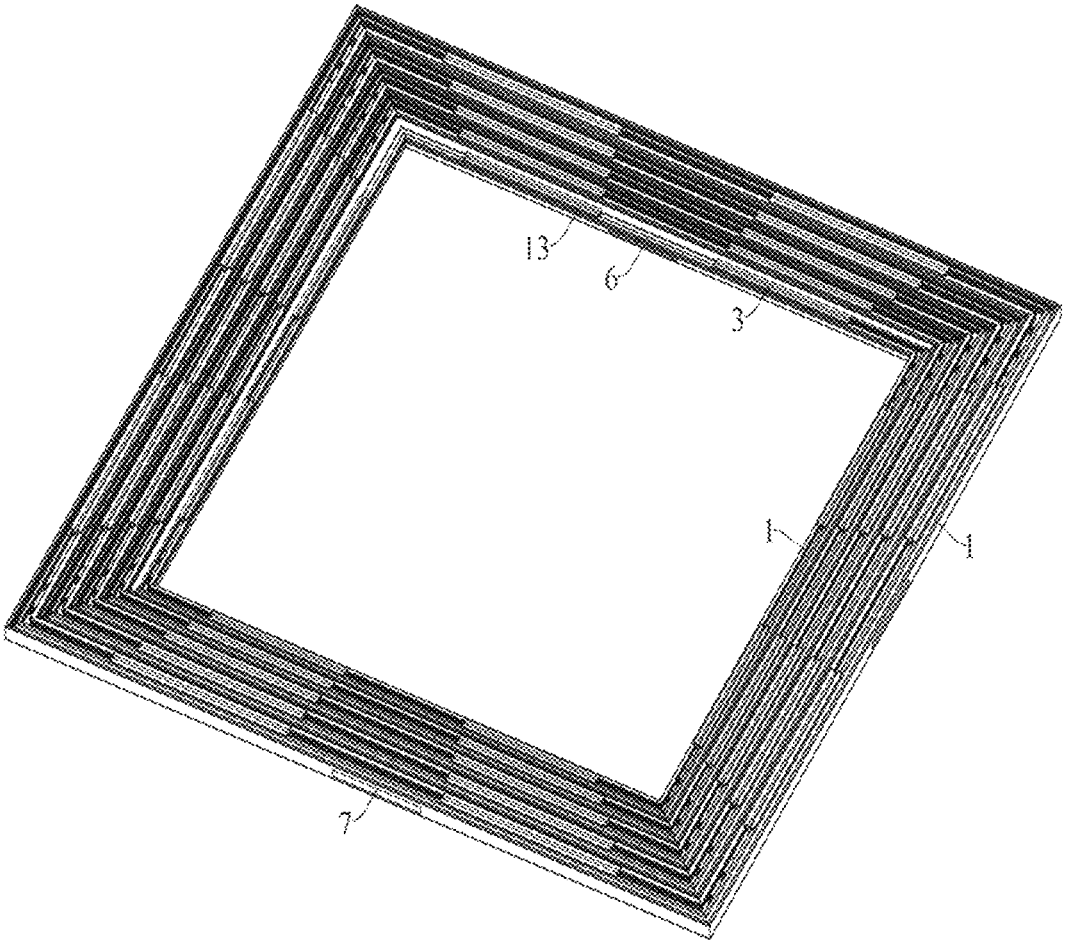
FIG. 7 is an assembly structural diagram of the rear perspective of all decorative picture frames after hiding the cover plate and all canvases in an embodiment of the present application.
Figure 8:
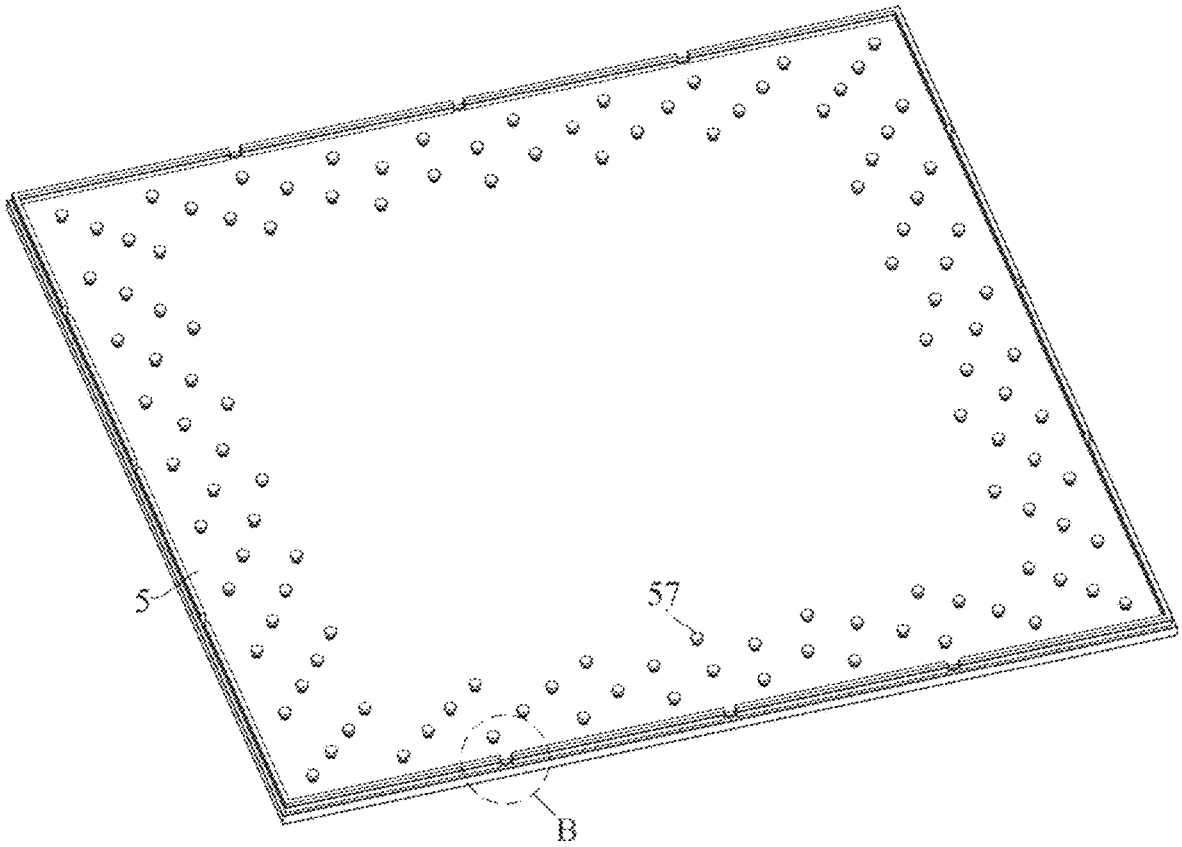
FIG. 8 is a structural diagram of the cover plate from the front perspective in an embodiment of the present application.
Figure 9:
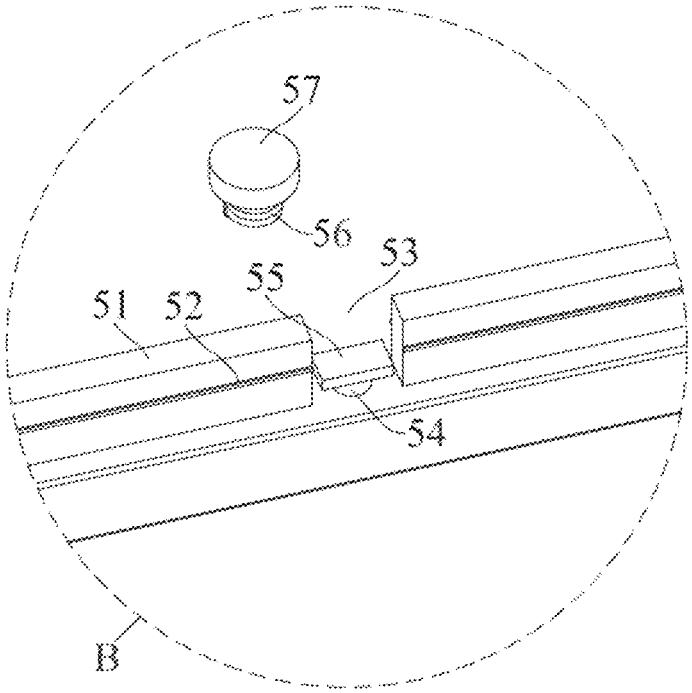
FIG. 9 is a partial enlarged view of Part B in FIG. 8.
Figure 10:
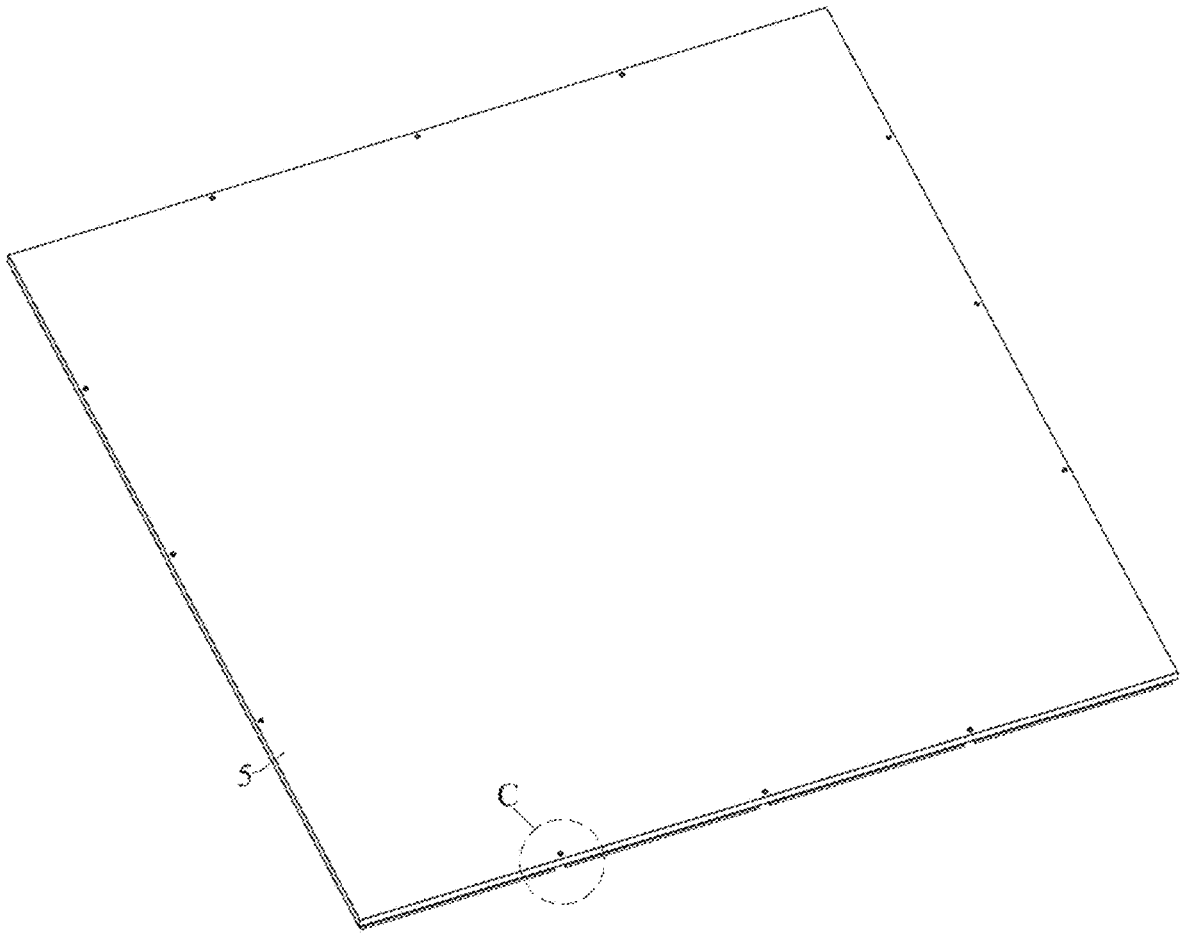
FIG. 10 is a structural diagram of the cover plate from the rear perspective in an embodiment of the present application.
Figure 11:
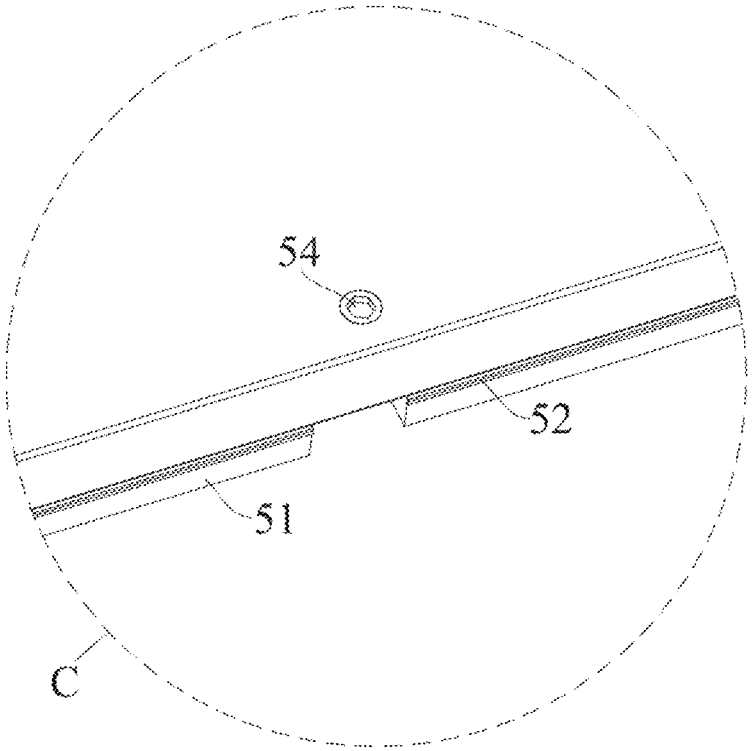
FIG. 11 is a partial enlarged view of Part C in FIG. 10.

Referring to FIGS. 7 and 8. It can be seen that in this embodiment, the compressing structure comprises a plurality of mutually spaced springs 56 fixed to the front side of the sealing cover plate 5. A soft abutment block 57 is provided at the front end of each spring 56, and the abutment block 57 abuts against the rear end of the decorative picture frame.

The area where the springs 56 are arranged corresponds to the position of the decorative picture frames. Therefore, when the sealing cover plate 5 is installed on the rear side of the external frame, the springs 56 compress and press all the decorative picture frames through the abutment blocks 57. In combination with the first magnetic sheet 6 and the second magnetic sheet 7 mentioned above, this can better prevent the decorative picture frames from shaking in the longitudinal direction during transportation, thus preventing damage to the decorative paintings.

Referring to FIGS. 8-11 and 17. It can be seen that in this embodiment, the rear end of the frame profile 1 is provided with a second insertion slot 12 extending along its length. The front side of the sealing cover plate 5 is provided with a positioning strip 51, which is configured for matching and inserting into the second insertion slot 12 of the external frame.

In this embodiment, at least one second anti-slip rib 52 is provided on opposite sides of the positioning strip 51 to make the positioning strip 51 more stably fixed inside the second insertion slot 12.

Furthermore, in this embodiment, a plurality of second retaining strips 15 are provided inside the second insertion slot 12, extending along the longitudinal direction and mutually spaced apart. A latch groove 16 is provided between adjacent second retaining strips 15. A rotation clearance 53 is provided on the extension path of the positioning strip 51. The sealing cover plate 5 is provided with a through hole for placing a rotating rod 54. The rear end of the rotating rod 54 is provided with a slot hole for a screwdriver to be inserted. The front end of the rotating rod 54 is provided with a limiting block 55, the limiting block 55 has an internal state where it is concealed within the rotational clearance 53, and a limiting state where it rotates and extends one end into the latch groove 16.

For easier understanding, the assembly process of the decorative painting assembly is explained below.

Referring to FIG. 1, firstly, the external frame is laid flat on the ground with the main canvas 41 facing downwards (a soft pad should be laid on the ground to prevent scratching the painting); secondly, all the remaining decorative paintings are placed in sequence on top of the underlying decorative painting, it is understandable that the main canvases 41 of all decorative paintings are facing downwards; after all decorative paintings are provided, the fixing strip 3 on the external frame is removed; thirdly, the positioning strip 51 on the sealing cover plate 5 is inserted into the second insertion slot 12 (at this time, part of the rear wrapping cloth 43 is pressed into the second insertion slot 12 by the positioning strip 51); fourthly, the fixing strip 3 on the external frame is reinstalled; finally, a screwdriver is used to rotate the rotating rod 54 and switch the limiting block 55 at the end of the rotating rod 54 to the limiting state to complete the installation of the sealing cover plate 5.

More specifically, a recess 13 extending along the length of the frame profile 1 is provided on the inner side wall of the frame profile 1, and the recess 13 is configured to accommodate the insertion of fingers.

The process of removing all decorative paintings from the decorative painting assembly is explained below.

Firstly, a screwdriver is used to rotate the rotating rod 54 and switch the limiting block 55 at the end of the rotating rod 54 to the internal state, and the sealing cover plate 5 is removed; then, fingers are inserted into the recess 13 and sequentially all decorative paintings located inside the largest decorative painting are removed from the inside out; when all decorative paintings are separated, the rear wrapping cloth 43 of the largest decorative painting (at this point, part of the rear wrapping cloth 43 enters the second insertion slot 12) is adjusted, the fixing strip 3 is removed on the external frame, the rear wrapping cloth 43 located in the second insertion slot 12 is pulled out, and the position of the rear wrapping cloth 43 is readjusted, and finally the fixing strip 3 is reinstalled.

The above-mentioned application of a decorative painting assembly convenient for transportation is merely a preferred embodiment of the present application, and does not limit the patent scope of the present application. Any equivalent structural transformation made under the inventive concept of the present application, or direct/indirect application in other related technical fields, is comprised within the patent protection scope of the present application.

The present application discloses a decorative painting assembly convenient for transportation, comprising a plurality of decorative picture frames with sizes progressively decreasing in proportion. The decorative picture frames are fixed with primary canvases, and the decorative picture frames are nested and stacked in sequence based on their sizes in proportion. Among adjacent decorative picture frames, the front surface of the primary canvas on one decorative picture frame abuts against the rear surface of the primary canvas on the other. The application achieves stacking of all decorative paintings according to their sizes in sequence, allowing for packaging of all decorative paintings with just one packaging box, which occupies little space and reduces logistics costs. Additionally, by arranging the tightening structure and compressing structure, the overall structure of the decorative painting assembly is made very stable.

The invention claimed is:

1. A decorative painting assembly convenient for transportation, comprising a plurality of decorative picture frames that progressively decrease in size in proportion, wherein the decorative picture frames have canvases fixed thereto, with the canvases comprising at least a main canvas laid flat on the front side of each decorative picture frame, and all the decorative picture frames are nested and stacked in sequence based on their sizes in proportion, and the main canvases of all the decorative picture frames are oriented towards the same side, an outermost decorative picture frame is configured as the outer frame; the front surface of the main canvas on one decorative picture frame abuts against the rear surface of the main canvas on the other decorative picture frame in adjacent decorative picture frames; a tightening structure that restricts relative movement in the horizontal direction between adjacent decorative picture frames is provided between the outer side of one decorative picture frame and the inner side of the other, the decorative painting assembly also comprises a cover plate installed on the rear side of the outer frame, with the cover plate having a compressing structure for pressing down on all the decorative picture frames inside the outer frame.

2. The decorative painting assembly convenient for transportation according to claim 1, wherein each decorative picture frame and its main canvas collectively form a decorative painting, and the front surface of the main canvas is laid flat with a film, which is positioned between the main canvases of adjacent decorative paintings.

3. The decorative painting assembly convenient for transportation according to claim 2, wherein the tightening structure comprises at least one first magnet provided on the inner side of the decorative picture frame and at least one second magnet provided on the outer side of the decorative picture frame, with adjacent decorative picture frames being securely connected to each other in the horizontal direction through the magnetic attraction between the first magnet and the second magnet.

4. The decorative painting assembly convenient for transportation according to claim 3, wherein the compressing structure comprises a plurality of mutually spaced springs fixed to the front side of the cover plate, with the front end of each spring having a soft abutment block that abuts against the rear end of the decorative picture frame.

5. The decorative painting assembly convenient for transportation according to claim 4, wherein the decorative picture frame comprises a plurality of frame profiles interconnected end-to-end, with connecting corner brackets provided between the ends of adjacent frame profiles.

6. The decorative painting assembly convenient for transportation according to claim 5, wherein the rear end of the frame profile is provided with a second slot extending along its length, and the front side of the cover plate is provided with a positioning strip for mating insertion into the second slot of the outer frame.

7. The decorative painting assembly convenient for transportation according to claim 6, wherein the inner side of the second slot is provided with a horizontally arranged latch groove, the extension path of the positioning strip is provided with at least one rotation allowance, the cover plate is provided with a through hole for placing a rotating rod, the rear end of the rotating rod is provided with a slot hole for a screwdriver to be inserted into, and the front end of the rotating rod is provided with a limiting block that has an internal state of being hidden in the rotation allowance and a limiting state of rotating and having one end extending into the latch groove.

8. The decorative painting assembly convenient for transportation according to claim 5, wherein the rear end of the frame profile is provided with a first insertion slot extending along its length, and at least one fixing strip is installed on the first insertion slot, the canvas also comprises a side wrapping cloth and a rear wrapping cloth disposed at the edge of the main canvas, with the side wrapping cloth tightly abutting against the outer side of the frame profile and the rear wrapping cloth arranged on the rear side of the frame profile, the fixing strip is configured to press part of the rear wrapping cloth into and fix it inside the first insertion slot.

9. The decorative painting assembly convenient for transportation according to claim 8, wherein the inner side of the first insertion slot is provided with at least one first clamping strip, and the fixing strip comprises an integrally formed insertion portion and abutment portion, wherein the insertion portion extends into the first insertion slot, the insertion portion and the first clamping strip collectively fix the rear wrapping cloth located inside the first insertion slot, the abutment portion is configured to press and fix the rear wrapping cloth located outside the first insertion slot onto the rear side of the frame profile.

10. The decorative painting assembly convenient for transportation according to claim 5, wherein the inner wall of the frame profile is provided with a recess extending along its length, which is configured to accommodate the insertion of fingers.

* * * * *